US008231205B2

(12) United States Patent
Suzuki

(10) Patent No.: US 8,231,205 B2
(45) Date of Patent: Jul. 31, 2012

(54) FLUID EJECTING HEAD AND FLUID EJECTING APPARATUS

(75) Inventor: Shigeki Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 527 days.

(21) Appl. No.: 12/047,611

(22) Filed: Mar. 13, 2008

(65) Prior Publication Data

US 2008/0225085 A1 Sep. 18, 2008

(30) Foreign Application Priority Data

Mar. 14, 2007 (JP) ..... 2007-065033

(51) Int. Cl.
*B41J 2/045* (2006.01)
*B41J 2/165* (2006.01)

(52) U.S. Cl. ..... 347/61; 347/35; 347/68

(58) Field of Classification Search ..... None
See application file for complete search history.

(56) References Cited

U.S. PATENT DOCUMENTS 6,637,865 B1 * 10/2003 Murakami et al. ..... 347/56

FOREIGN PATENT DOCUMENTS

| | | |
|---|---|---|
| JP | 06-270400 | 9/1994 |
| JP | 11-078018 | 3/1999 |
| JP | 2001-038890 | 2/2001 |
| JP | 2003-291370 | 10/2003 |

* cited by examiner

*Primary Examiner* — Jerry Rahll
(74) *Attorney, Agent, or Firm* — Maschoff Gilmore & Israelsen

(57) ABSTRACT

A fluid ejecting head includes a fluid storage chamber that temporarily stores a fluid, which is supplied from a fluid supply port, a plurality of pressure chambers, to which the fluid stored in the fluid storage chamber is supplied through a plurality of fluid supply paths, respectively, a plurality of driving elements that change pressure in the pressure chambers, respectively, and a plurality of nozzle openings, from which the fluids contained in the pressure chambers are ejected when the driving elements are driven, respectively. A specific driving element most distant from the fluid supply port among the driving elements has a maximum capability to discharge the air bubbles in the fluid from the nozzle opening among the driving elements.

4 Claims, 5 Drawing Sheets

FLUID EJECTING HEAD AND FLUID EJECTING APPARATUS

BACKGROUND

1. Technical Field

The present invention relates to a fluid ejecting apparatus, such as an ink jet type printer, and to a fluid ejecting head for a fluid ejecting apparatus.

2. Related Art

In general, as a fluid ejecting apparatus that ejects a fluid onto a target, an ink jet type printer (hereinafter, referred to as 'printer') is widely known. In such a printer, ink is supplied to a recording head (fluid ejecting head) that ejects ink (fluid), and ink is ejected from nozzle openings in the recording head onto a recording paper as the target for printing (for example, JP-A-2003-291370).

A recording head for the printer described in JP-A-2003-291370 includes a plurality of nozzle openings, a plurality of pressure generating chambers (pressure chamber) that correspondingly communicate with the nozzle openings, a single ink chamber (fluid storage chamber) that communicates with the pressure generating chambers through a plurality of ink supply paths (fluid supply path), respectively, an ink supply port (fluid supply port) that supplies ink to the ink chambers, and a plurality of piezoelectric vibrators (driving element) that are correspondingly mounted on vibrating plates, which form parts of the pressure generating chambers, respectively. With this configuration, if a driving voltage is applied to the piezoelectric vibrator to expand and contract the piezoelectric vibrator, the pressure in the pressure generating chamber changes, and ink in the pressure generating chamber is ejected from the nozzle openings by the change in pressure.

In the recording head for the printer described in JP-A-2003-291370, ink that is supplied from the ink supply port to the corresponding ink chamber is likely to suffer from stagnation at a position in the ink chamber distant from the ink supply port rather than a position close to the ink supply port. For this reason, at the position in the ink chamber distant from the ink supply port, ink may be thickened or air bubbles may be collected. Accordingly, in the printer described in JP-A-2003-291370, when cleaning is performed to suck thickened ink or air bubbles from the nozzle openings and discharge thickened ink or air bubbles, the driving frequency of a piezoelectric vibrator that is close to the ink supply port is set to be larger than that of a piezoelectric vibrator that is distant from the ink supply port, such that thickened ink or air bubbles in the ink chamber are effectively discharged.

In the printer described in JP-A-2003-291370, according to the relative position of the piezoelectric vibrator to the ink supply port, the driving pattern for driving the piezoelectric vibrator is changed for every piezoelectric vibrator. Accordingly, a plurality of driving patterns are needed to drive the piezoelectric vibrators, which results in complicating the circuit configuration.

SUMMARY

An advantage of some aspects of the invention is that it provides a fluid ejecting head and a fluid ejecting apparatus, which is capable of effectively discharging air bubbles collected therein, without using a complex circuit configuration.

According to an aspect of the invention, a fluid ejecting head includes a fluid storage chamber that stores a fluid, which is supplied from a fluid supply port, a plurality of pressure chambers, to which the fluid stored in the fluid storage chamber is supplied through a plurality of fluid supply paths, respectively, a plurality of driving elements that change pressure in the pressure chambers, respectively, and a plurality of nozzle openings, from which the fluids contained in the pressure chambers are ejected when the driving elements are driven, respectively. A specific driving element most distant from the fluid supply port among the driving elements has a maximum capability to discharge the air bubbles in the fluid from the nozzle opening among the driving elements.

Usually, the fluid supplied from the fluid supply port to the fluid storage chamber is likely to be stagnated at a position distant from the fluid supply port rather than a position close to the fluid supply port. In particular, at the position in the fluid storage chamber distant from the fluid supply port, the air bubbles in the fluid may be collected. According to the aspect of the invention, the specific driving element most distant from the fluid supply port among the driving elements has a maximum capability to discharge the air bubbles in the fluid from the nozzle opening among the driving elements.

In the fluid ejecting head according to the aspect of the invention, the plurality of fluid supply paths may be arranged in parallel with each other, and among the driving elements, the specific driving element may have a maximum width in the arrangement direction of the fluid supply paths.

According to this configuration, when the same driving force is applied to the driving elements, the change amount of a pressure in the pressure chamber corresponding to the specific driving element can become larger than the change amount of a pressure in each of the pressure chambers corresponding to other driving elements.

In the fluid ejecting head according to the aspect of the invention, among the driving elements, the specific driving element may have a maximum height in a direction perpendicular to both the arrangement direction of the fluid supply paths and a direction in which the individual fluid supply paths extend.

According to this configuration, even if the same driving force is applied to the driving elements, the change amount of the pressure in the pressure chamber corresponding to the specific driving element can become larger than the change amount of the pressure in each of the pressure chambers corresponding to other driving elements.

In the fluid ejecting head according to the aspect of the invention, the sectional area of the fluid supply path, the sectional area of the pressure chamber, and the diameter of the nozzle opening, which correspond to the specific driving element, may have maximum values among the sectional areas of the fluid supply paths, the sectional areas of the pressure chambers, and the diameters of the nozzle openings.

According to this configuration, the flow rate of the fluid that flows in the fluid supply path, the pressure chamber, and the nozzle opening corresponding to the specific driving element is increased. Therefore, the capability to discharge the air bubbles from the nozzle opening corresponding to the specific driving element can be improved.

In the fluid ejecting head according to the aspect of the invention, the driving elements may be all configured to be driven by the same driving pattern.

According to this configuration, the driving elements are all driven by the same driving pattern, and thus the circuit configuration can be simplified.

According to another aspect of the invention, a fluid ejecting apparatus includes the above-described fluid ejecting head.

According to another aspect of the invention, the air bubbles collected inside can be effectively discharged, without using a complex circuit configuration.

BRIEF DESCRIPTION OF THE DRAWINGS

The invention will be described with reference to the accompanying drawings, wherein like numbers reference like elements.

DESCRIPTION OF EXEMPLARY EMBODIMENT

An exemplary embodiment of the invention will now be described with reference to the drawings, in which a fluid ejecting apparatus is embodied in an ink jet type printer. Moreover, in the following description, 'the front-back direction', 'the up-down direction', and 'the left-right direction' are the same as 'the front-back direction', 'the up-down direction', and 'the left-right direction' in FIG. 1, unless the definitions limiting them are provided.

Figure 1:
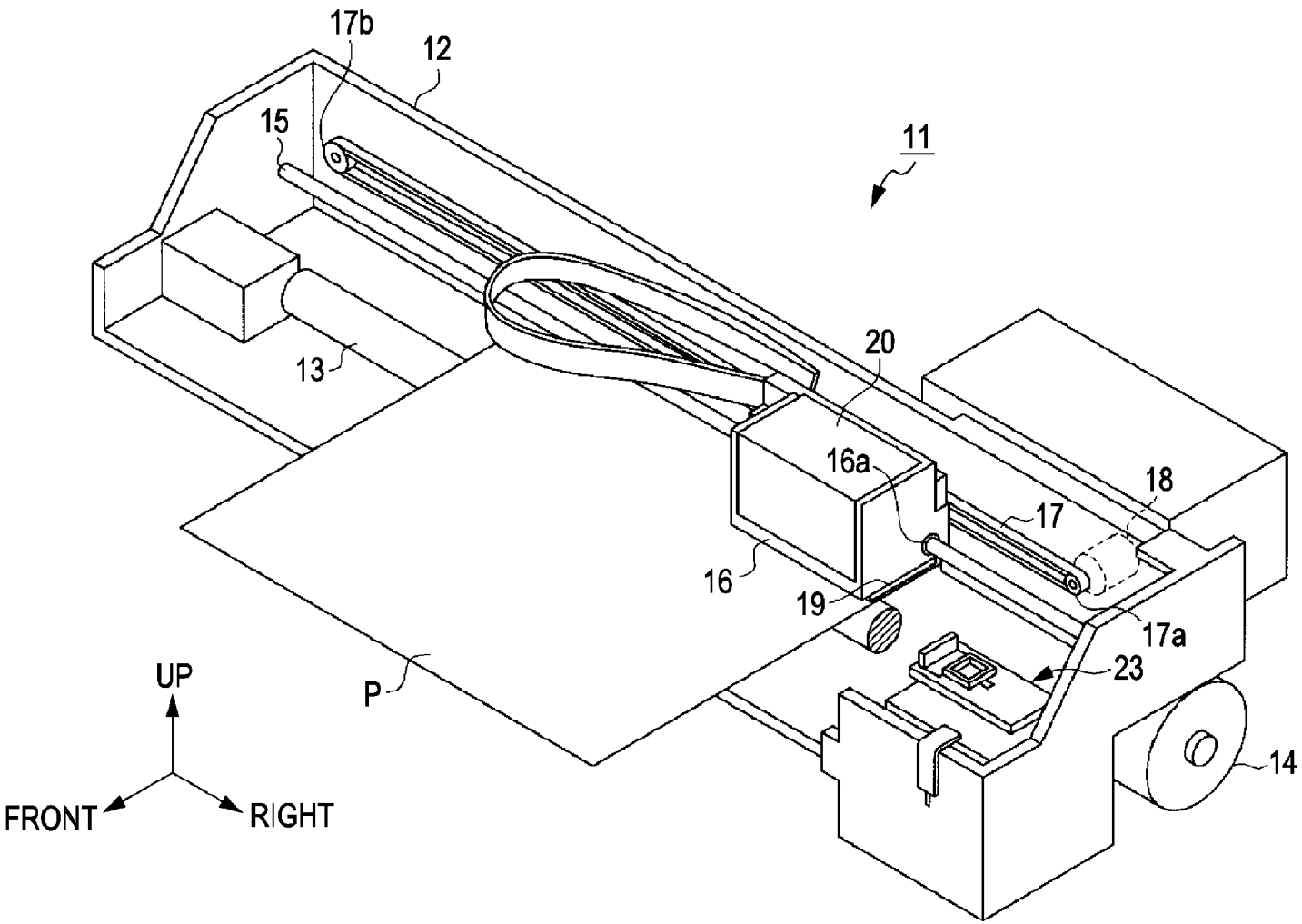
FIG. 1 is a perspective view of an ink jet type printer according to an embodiment of the invention.

As shown in FIG. 1, an ink jet type printer 11 as a fluid ejecting apparatus includes a substantially rectangular boxlike frame 12. The frame 12 has a platen 13 at the lower portion in the left-right direction, that is, in the longitudinal direction. Onto the platen 13, a recording paper P is fed from the rear side by a paper feed mechanism (not shown) when a paper feed motor 14 provided below the lower surface of the frame 12 is driven.

In the frame 12, a guide shaft 15 is provided above the platen 13 in the longitudinal direction of the platen 13. A carriage 16 is supported by the guide shaft 15 to reciprocate in the axial direction of the guide shaft 15 (left-right direction). That is, the carriage 16 is supported to freely reciprocate in the longitudinal direction of the guide shaft 15 by inserting the guide shaft 15 into a support hole 16*a*, which is formed to pass through the carriage 16 in the left-right direction.

At the inner surface of a rear wall of the frame 12, a driving pulley 17*a* and a driven pulley 17*b* are rotatably supported to correspond to both ends of the guide shaft 15. An output shaft of a carriage motor 18 that serves as a driving source to reciprocate the carriage 16 is connected to the driving pulley 17*a*. An endless timing belt 17 that is connected to the carriage 16 is stretched between the pair of pulleys 17*a* and 17*b*. Accordingly, the carriage 16 is guided by the guide shaft 15 and reciprocates in the left-right direction through the endless timing belt 17 by a driving force of the carriage motor 18.

A recording head 19 as a fluid ejecting head is provided to face the lower surface of the carriage 16, and an ink cartridge 20 is detachably mounted on the carriage 16 to supply ink (fluid) to the recording head 19. Ink in the ink cartridge 20 is supplied from the ink cartridge 20 to the recording head 19 when a piezoelectric element 21 (see FIG. 2) in the recording head 19 is driven, and is then ejected from a plurality of nozzle openings 22 (see FIG. 2) in the recording head 19 onto the recording paper P, which is fed onto the platen 13 for printing.

Moreover, in a home position region (non-printing region) at the right end in the frame 12 where the recording paper P does not reach, a maintenance unit 23 is provided to perform maintenance of the recording head 19 when printing is not performed.

Next, the recording head 19 will be described in detail.

Figure 2:
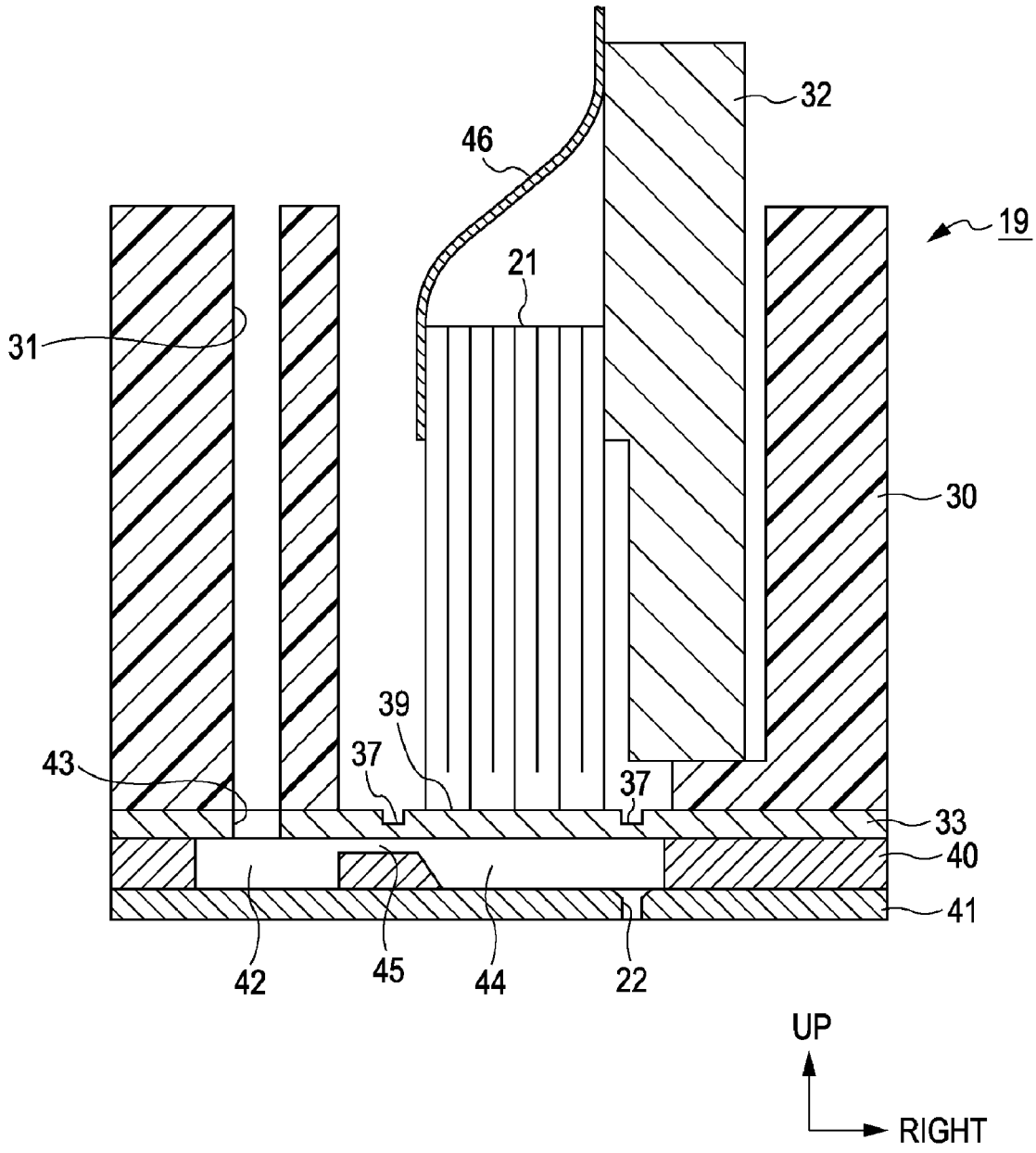
FIG. 2 is a cross-sectional view of a recording head according to an embodiment of the invention.

As shown in FIG. 2, the recording head 19 includes a tubular main body case 30. At a left-leaning position in the main body case 30, a first ink supply path 31 is formed to pass through the main body case 30 in the up-down direction. At a right-leaning position in the main body case 30, a fixing substrate 32 is provided erect.

To the lower surface of the main body case 30, an elastic and rectangular thin plate-shaped vibrating plate 33 is provided to cover a lower end opening of the main body case 30 and a lower end opening of the first ink supply path 31. In addition, in the main body case 30, an upper end at the right side surface of the piezoelectric element 21 having a long boxlike shape in the front-back direction is fixed to the left side surface of the fixing substrate 32, and the lower surface of the piezoelectric element 21 is fixed to the upper surface of the vibrating plate 33.

Figure 3:
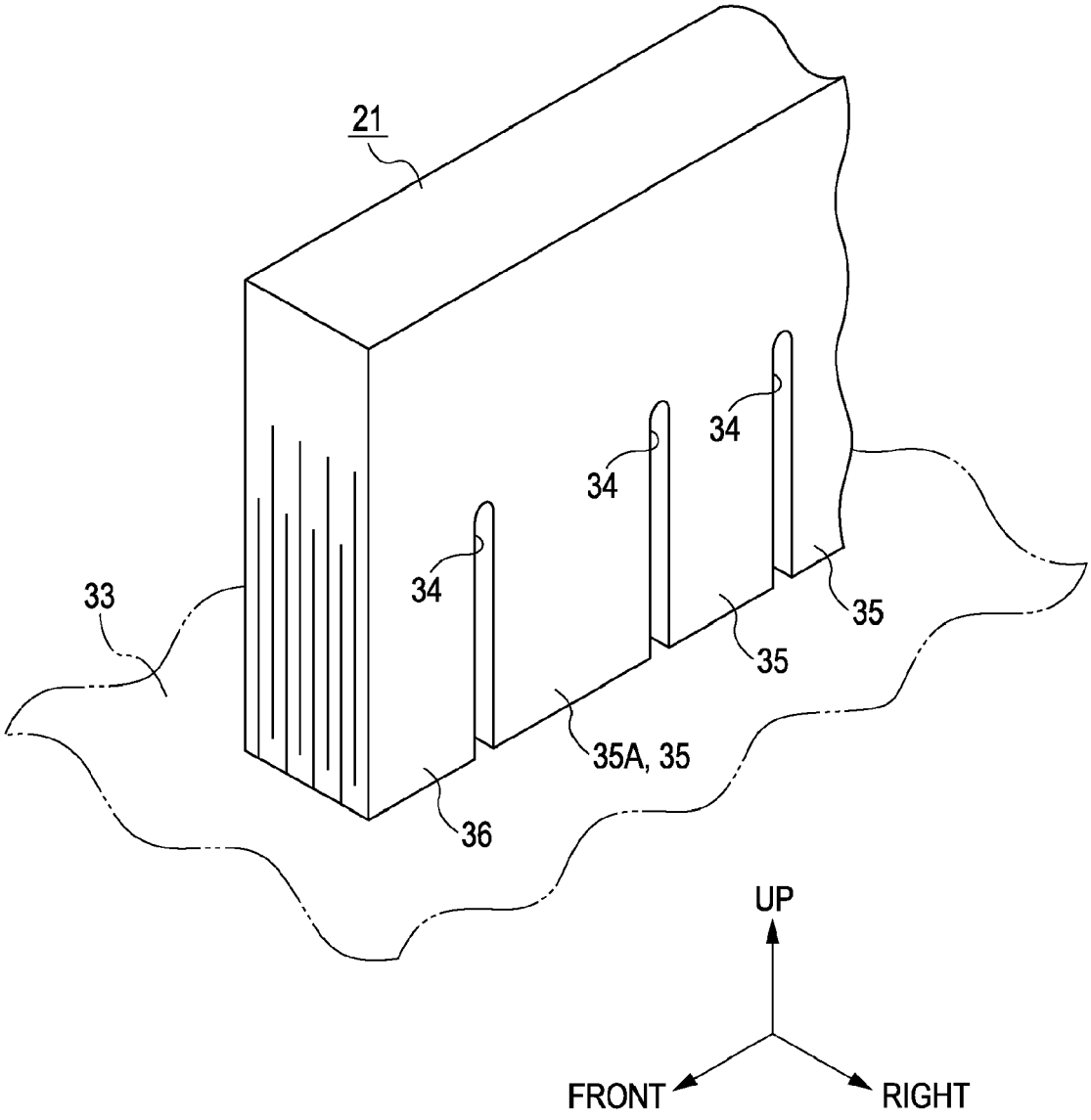
FIG. 3 is a perspective view of a piezoelectric element according to an embodiment of the invention.

As shown in FIG. 3, at the lower portion of the piezoelectric element 21, a plurality of cutout grooves 34 are provided at intervals in the front-back direction to extend over the entire width of the piezoelectric element 21 in the left-right direction at intervals. The depth of each of the cutout grooves 34 is set to be half of the height of the piezoelectric element 21 in the up-down direction. Each portion between of the cutout grooves 34 in the piezoelectric element 21 becomes a vibrating portion 35. In this embodiment, each vibrating portion 35 forms a driving element.

Among the vibrating portions 35, the vibrating portions 35 at both ends in the front-back direction of the piezoelectric element 21 are specific vibrating portions 35A that have a width in the front-back direction larger than other vibrating portions 35. In this embodiment, specific vibrating portions 35A form specific driving elements. In the piezoelectric element 21, portions outside the specific vibrating portions 35A in the front-back direction become dummy vibrating portions 36. A ground line is adhered to both the dummy vibrating portions 36 to ground the piezoelectric element 21. Moreover, the piezoelectric element 21 is symmetric in the front-back direction and the left-right direction.

Figure 5:
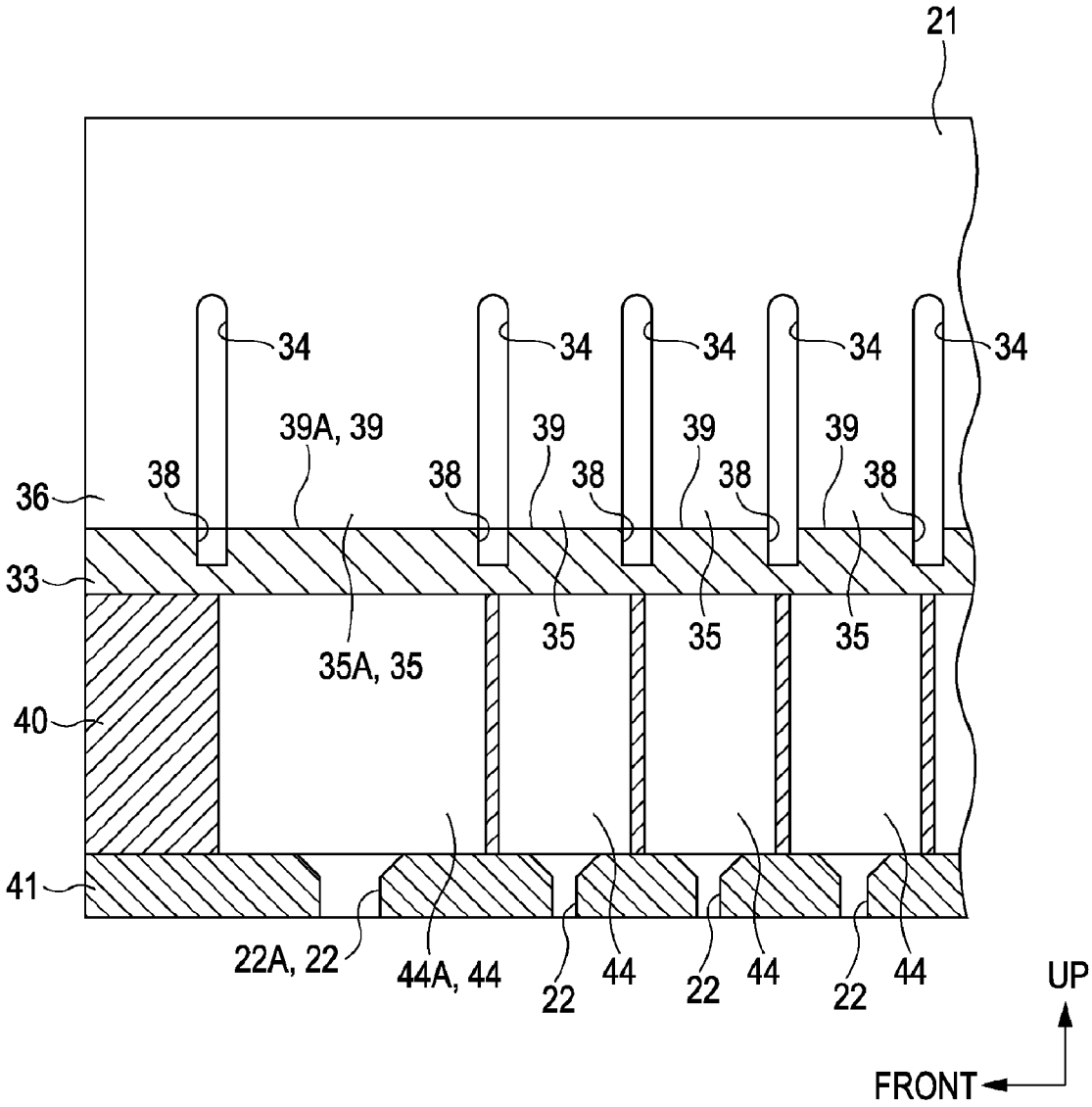
FIG. 5 is an exploded cross-sectional view showing the essential parts of a recording head according to an embodiment of the invention.

As shown in FIGS. 2 and 5, vertical grooves 37 are formed on both sides at the upper surface of the vibrating plate 33 with the piezoelectric element 21 interposed therebetween to extend in the front-back direction. Meanwhile, horizontal grooves 38 are formed at positions corresponding to the cutout grooves 34 of the piezoelectric element 21 at the upper surface of the vibrating plate 33 to extend in the left-right direction so as to connect both the vertical grooves 37 with each other. In the vibrating plate 33, portions defined by both the vertical grooves 37 and the individual horizontal grooves 38 form island portions 39. The island portions 39 correspond to the vibrating portions 35 of the piezoelectric element 21. Among the island portions 39, the specific island portions 39A corresponding to the specific vibrating portions 35A have an area larger than other island portions 39 in plan view.

Figure 4:
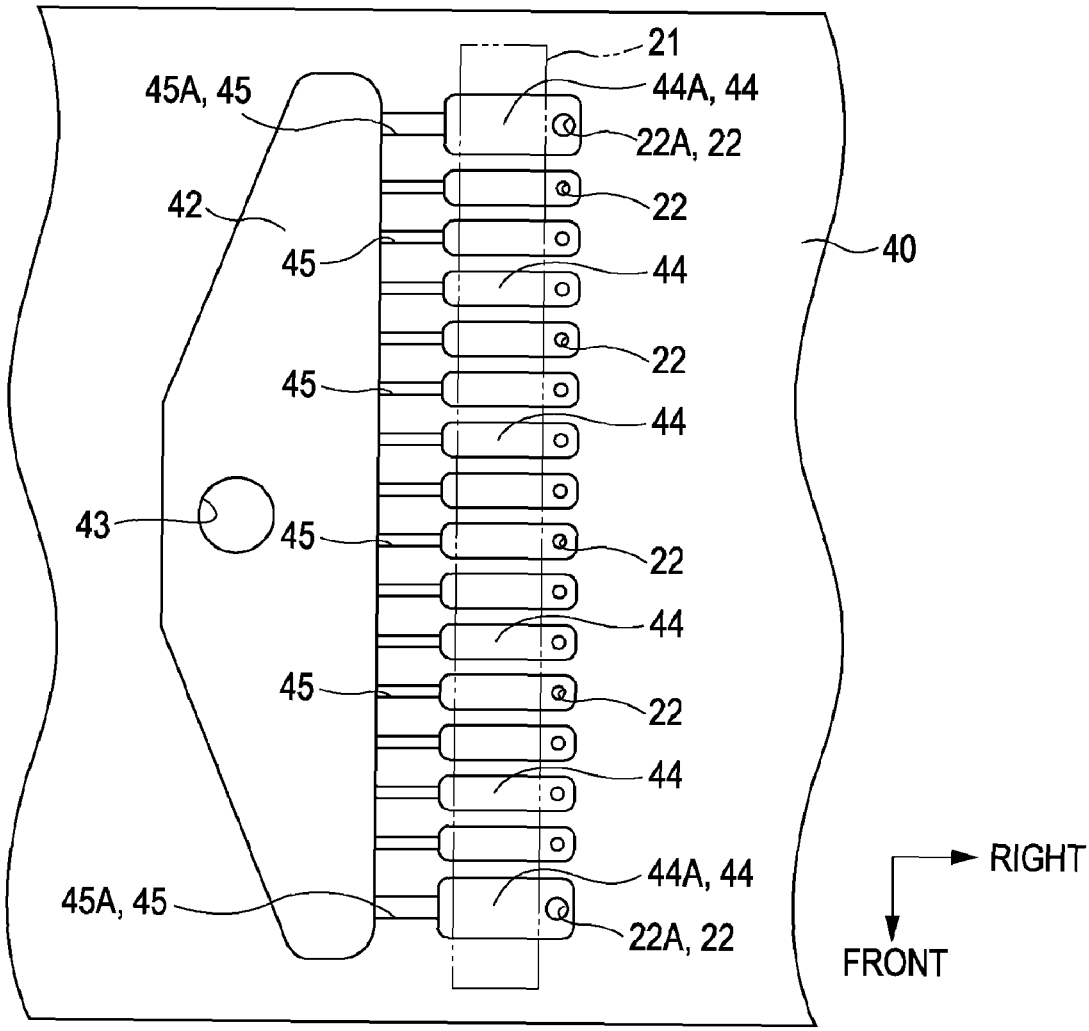
FIG. 4 is a plan view of a flow passage forming plate according to an embodiment of the invention.

As shown in FIGS. 2, 4, and 5, a rectangular frame-shaped flow passage forming plate 40 is in close contact with and fixed to the lower surface of the vibrating plate 33, and a rectangular plate-shaped nozzle plate 41 is in close contact with and fixed to the lower surface of the flow passage forming plate 40. An ink storage chamber 42 as a long fluid storage chamber in the front-back direction is formed at a left-leaning position between the vibrating plate 33 and the nozzle plate 41. The ink storage chamber 42 communicates with the first ink supply path 31 through a communicating port 43 as a fluid supply port, which is formed in the vibrating plate 33. The ink storage chamber 42 temporarily stores ink that is supplied from the ink cartridge 20 (see FIG. 1) through the first ink supply path 31.

The communicating port 43 is formed at the center in the front-back direction of the ink storage chamber 42. Among the vibrating portions 35 of the piezoelectric element 21, the specific vibrating portions 35A are disposed most distant from the communicating port 43. In this case, the specific vibrating portions 35A are distant from the communicating port 43 as the same distance.

At a right-leaning position between the vibrating plate 33 and the nozzle plate 41, a plurality of pressure chambers 44 are formed to be arranged in the front-back direction to correspond to the vibrating portions 35 of the piezoelectric element 21 in the up-down direction. In this case, both the dummy vibrating portions 36 of the piezoelectric element 21 do not correspond to any pressure chambers 44.

Between the vibrating plate 33 and the nozzle plate 41, a plurality of second ink supply paths 45 as a plurality of fluid supply paths, which extend in the left-right direction, are formed in parallel with each other in the left-right direction between the ink storage chamber 42 and the individual pressure chambers 44. The ink storage chamber 42 and the pressure chambers 44 communicate with each other through the second ink supply path 45, respectively. Accordingly, ink that is temporarily stored in the ink storage chamber 42 is supplied to the pressure chambers 44 through the second ink supply paths 45, respectively.

In this case, among the pressure chambers 44, specific pressure chambers 44A at front and back ends corresponding to the specific vibrating portions 35A have a sectional area larger than those of other pressure chambers 44 when cut in a direction perpendicular to an ink flow direction. In addition, among the second ink supply paths 45, specific second ink supply paths 45A at front and back ends corresponding to the specific vibrating portions 35A have a sectional area larger than those of other second ink supply paths 45 when cut in the direction perpendicular to the ink flow direction.

In the nozzle plate 41, nozzle openings 22 are provided to correspond to the right ends of the individual pressure chambers 44. That is, in the nozzle plate 41, the nozzle openings 22 are provided to be arranged in the front-back direction. In this case, among the nozzle openings 22, specific nozzle openings 22A at front and back ends corresponding to the specific vibrating portions 35A have a diameter larger than those of other nozzle openings 22.

An end of a strip-shaped flexible circuit board 46 is connected to an upper end at the left side surface of the piezoelectric element 21, and the other end of the flexible circuit board 46 is connected to a control unit (not shown) of the ink jet type printer 11 (see FIG. 1). Then, if a driving signal generated by the control unit (not shown) is input to the piezoelectric element 21 through the flexible circuit board 46, the individual vibrating portions 35 of the piezoelectric element 21 expand and contract (are driven) in the up-down direction. Here, the vibrating portions 35 all expand and contract (are driven) by the same driving pattern.

According to the expansion and contraction of the individual vibrating portions 35, the island portions 39 of the vibrating plate 33 vibrate, and the pressure in the individual pressure chambers 44 is changed. With the changes in pressure of the individual pressure chambers 44, ink in the individual pressure chambers 44 is ejected from the individual nozzle openings 22.

Next, an operation to discharge air bubbles, which are mixed in the recording head 19, will be described.

If the air bubbles are mixed in the recording head 19, the air bubbles remain at both ends in the front-back direction of the ink storage chamber 42. This is because, in the ink storage chamber 42, the flow rate of ink during printing is smaller at both ends in the front-back direction distant from the communicating port 43 than at the center in the front-back direction close to the communicating port 43.

Now, to discharge the air bubbles mixed in the recording head 19, first, the control unit (not shown) inputs a driving signal having no relation with printing to the piezoelectric element 21. Here, since the vibrating portions 35 are formed as a single body by the single piezoelectric element 21, they all expand and contract (are driven) in the up-down direction by the same driving pattern. If so, the island portions 39 of the vibrating plate 33 vibrates up and down, the pressure chambers 44 corresponding to the island portions 39 are alternately reduced in pressure and pressurized, ink in the pressure chambers 44 are discharged to the outside through the nozzle openings 22, together with the air bubbles.

At this time, the sectional areas of the specific second ink supply paths 45A, the widths of the specific vibrating portions 35A in the front-back direction, the areas of the specific island portions 39A, the sectional areas of the specific pressure chambers 44A, and the diameters of the specific nozzle openings 22A, which correspond to both ends in the front-back direction of the ink storage chamber 42, become larger than the sectional areas of other second ink supply paths 45, the widths of other vibrating portions 35 in the front-back direction, the areas of other island portions 39, the sectional areas of other pressure chambers 44, and the diameters of other nozzle openings 22, respectively.

That is, with the specific vibrating portions 35A having a width larger than those of other vibrating portions 35 in the front-back direction, the specific island portions 39A having an area larger than those of other island portions 39 vibrate up and down. In addition, ink that pass through the specific second ink supply paths 45A, the specific pressure chambers 44A, and the specific nozzle openings 22A has resistance smaller than that of ink that passes through other second ink supply paths 45, other pressure chambers 44, and other nozzle openings 22.

For this reason, the amount of ink that is supplied from the ink storage chamber 42, passes through the specific second ink supply paths 45A and the specific pressure chambers 44A, and is discharged from the specific nozzle openings 22A is significantly increased. Therefore, the air bubbles that remain at both ends in the front-back direction of the ink storage chamber 42 are effectively discharged, together with ink.

According to the above-described embodiment, the following advantages can be obtained.

(1) Both the specific vibrating portion 35A that are most distant from the communicating port 43 have a width in the front-back direction larger than those of other vibrating portions 35. Accordingly, even if the same driving signal is applied to all of the vibrating portions 35, which form the piezoelectric element 21, the change amount of pressure in the specific pressure chambers 44A can become larger than the change amount of pressure in other pressure chambers 44. For this reason, the air bubbles that are collected at both ends in the front-back direction of the ink storage chamber 42, in which the air bubbles are particularly likely to remain, can be effectively discharged from the specific nozzle openings 22A, without using a complex circuit configuration.

(2) The sectional areas of the specific second ink supply paths 45A, the sectional areas of the specific pressure chambers 44A, and the diameters of the specific nozzle openings 22A, which correspond to the specific vibrating portions 35A arranged to correspond to both ends in the front-back direction of the ink storage chamber 42 are larger than the sectional areas of other second ink supply paths 45, the sectional areas of other pressure chambers 44, and the diameters of other nozzle openings 22, respectively. For this reason, the flow rate of ink that passes through the specific second ink supply paths 45A, the specific pressure chambers 44A, and the specific nozzle openings 22A can be increased. Therefore, the capability to discharge the air bubbles from the specific nozzle openings 22A can be improved.

(3) The vibrating portions 35 are all driven by the same driving pattern. Therefore, the circuit configuration of the control unit (not shown) of the ink jet type printer 11 or the flexible circuit board 46 can be simplified.

Modifications

The above-described embodiment may be changed as follows.

Among the vibrating portions 35, the specific vibrating portions 35A may have a maximum height in the up-down direction that is perpendicular to both the arrangement direction of the second ink supply paths 45 and a direction in which the second ink supply paths 45 extend. However, the specific vibrating portions 35A need to be composed of piezoelectric elements separately from the piezoelectric element 21 having the vibrating portions 35. In this case, the widths in the front-back direction of the specific vibrating portions 35A may be the same as those of other vibrating portions 35 or may be larger than those of other vibrating portions 35.

According to this configuration, when the same driving force is applied to the specific vibrating portions 35A and other vibrating portions 35, the amplitude when the specific vibrating portions 35A expand and contract becomes larger than the amplitude when other vibrating portions 35 expand and contract. For this reason, the change amount of pressure in the specific pressure chambers 44A corresponding to the specific vibrating portions 35A can become larger than the change amount of pressure in other pressure chambers 44 corresponding to other vibrating portions 35. Therefore, the air bubbles that are collected at both ends in the front-back direction of the ink storage chamber 42, in which the air bubbles are particularly likely to remain, can be effectively discharged from the specific nozzle openings 22A, without using a complex circuit configuration.

The vibrating portions 35 may be composed of separate piezoelectric elements. In this case, each of the piezoelectric elements forms a driving element.

The vibrating portions 35 may be secondarily driven when the air bubbles or thickened ink is sucked and discharged from the nozzle openings 22 by a suction pump (not shown), that is, during so-called cleaning.

Among the vibrating portions 35 that are arranged in parallel with each other in the front-back direction, two or three vibrating portions 35 at the individual ends may be used as the specific vibrating portion 35A.

In regards to the vibrating portions 35 that are arranged in parallel with each other in the front-back direction, the widths in the front-back direction of the vibrating portions 35 may be increased one by one as they go from the central portion toward both ends.

In regards to the vibrating portions 35 that are arranged in parallel with each other in the front-back direction, the widths in the front-back direction of the vibrating portions 35 may be increased two by two or more as they go from the central portion toward both ends.

In the above-described embodiment, the fluid ejecting apparatus may be embodied in a so-called full-line type (line head type) printer in which, in a direction intersecting a transfer direction (front-back direction) of the recording paper P, the entire shape of the recording head 19 corresponds to the length in the widthwise direction (left-right direction) of the recording paper P. Alternatively, the fluid ejecting apparatus may be an off-carriage type printer in which an ink cartridge is provided at a place in the ink jet type printer, not on the carriage, and ink in the ink cartridge is supplied to the recording head by an ink supply tube.

Although, in the above-described embodiment, the fluid ejecting apparatus is embodied in the ink jet type printer 11, the invention is not limited thereto. The invention may be embodied in a fluid ejecting apparatus that ejects or discharges a fluid other than ink (a liquid, a liquid state material, in which particles of function material are dispersed or mixed, or a fluid state material, such as gel). For example, it may be a liquid ejecting apparatus that ejects a liquid state material, in which an electrode material or a color material (pixel material) is dispersed or dissolved, and is used in manufacturing a liquid crystal display, an EL (Electro Luminescence) display, or a field emission display, a liquid ejecting apparatus that ejects a bioorganic material used in manufacturing a bio-chip, or a liquid ejecting apparatus that ejects a liquid (sample) as a precision pipette. In addition, it may be a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, a liquid ejecting apparatus that ejects an etchant, such as acid or alkali, to etch a substrate, or a liquid ejecting apparatus that ejects a liquid state material, such as gel (for example, physical gel). The invention can be applied to one of fluid ejecting apparatuses. Moreover, in this specification, the term 'fluid' is a concept including a liquid (an inorganic solvent, an organic solvent, a solution, liquid resin, a liquid metal (metal melt)), a liquid state material, or a fluid state material, not a fluid containing only gas.

What is claimed is:

1. A fluid ejecting head comprising:

a fluid storage chamber that stores a fluid, which is supplied from a fluid supply port;

a plurality of pressure chambers, to which the fluid stored in the fluid storage chamber is supplied through a plurality of fluid supply paths, respectively;

a plurality of driving elements that change pressure in the pressure chambers, respectively; and a plurality of nozzle openings, from which the fluids contained in the pressure chambers are ejected when the driving elements are driven, respectively, wherein a specific driving element most distant from the fluid supply port among the driving elements has a maximum capability to discharge the air bubbles in the fluid from the nozzle opening among the driving elements, and wherein, among the driving elements, the specific driving element has a height in a direction perpendicular to both the arrangement direction of the fluid supply paths and a direction in which the individual fluid supply paths extend, the height of the specific driving element being greater than a height of the remaining driving elements.

2. The fluid ejecting head according to claim 1, wherein the plurality of fluid supply paths are arranged in parallel with each other, and among the driving elements, the specific driving element has a maximum width in the arrangement direction of the fluid supply paths.

3. A fluid ejecting apparatus comprising the fluid ejecting head according to claim 1.

4. The fluid ejecting head according to claim 1, wherein the sectional area of the fluid supply path, the sectional area of the pressure chamber, and the diameter of the nozzle opening, which correspond to the specific driving element, have maximum values among the sectional areas of the fluid supply paths, the sectional areas of the pressure chambers, and the diameters of the nozzle openings.

* * * * *